United States Patent [19]

Miller et al.

[11] Patent Number: 4,776,190

[45] Date of Patent: Oct. 11, 1988

[54] RADIOLOGICAL DETECTION RESISTANT KEY CHANGEABLE COMBINATION LOCK

[75] Inventors: Harry C. Miller, Nicholasville, Ky.; Stephen Helesfai, Rochesterm, N.Y.; John R. Bishop, Lexington; Gregory Lainhart, Nicholasville, both of Ky.

[73] Assignee: Sargent & Greenleaf, Inc., Nicholasville, Ky.

[21] Appl. No.: 6,703

[22] Filed: Jan. 22, 1987

[51] Int. Cl.[4] ..... E05B 37/08

[52] U.S. Cl. ..... 70/303 A; 70/316; 70/323; 70/333 A

[58] Field of Search ..... 70/323, 315, 316, 317, 70/318, 333 R, 303 R, 303 A

[56] References Cited

U.S. PATENT DOCUMENTS

| | | | |
|---|---|---|---|
| 2,856,765 | 10/1958 | Sreb | 70/323 |
| 2,970,217 | 1/1961 | Enikeieff . | |
| 3,024,640 | 3/1962 | Miller . | |
| 3,237,435 | 1/1966 | Paul . | |
| 3,254,519 | 6/1966 | Paul . | |
| 3,339,382 | 9/1967 | Miller et al. . | |
| 3,983,727 | 10/1976 | Todd . | |
| 4,040,280 | 8/1977 | Main | 70/323 |
| 4,163,376 | 8/1979 | Miller et al. . | |

*Primary Examiner*—Robert L. Wolfe

*Attorney, Agent, or Firm*—Mason, Fenwick & Lawrence

[57] ABSTRACT

A combination lock of the type adapted for changing of the combination by a change key, a lock case housing, a stack of a plurality of tumbler wheels loosely journaled on a tumbler post for rotation about its axis and each including an annular outer rim portion and an inner annular hub portion having teeth releasably intercoupling the hub portion and rim portion at any of a plurality of relative angular positions. The rim portions of the tumbler wheels have specially shaped peripheral gates to receive confronting portions of a fence on the fence lever when the tumbler wheels are properly aligned. The tumbler post is supported within the tumbler wheel hub portions for nonrotatable axial movement to shift the hub portions axially relative to the outer rim portions between coupled and decoupled relation. An actuator is activated by rotation of the change key for axially moving the tumbler post and the tumbler wheel hub portions to shift the hub portions to decoupled relation for combination change and a secondary change fence member is slidable rectilinearly into inserted relation in the tumbler wheel gates and retractable therefrom upon movement the of the actuator to selectively hold the rim portion against rotation.

26 Claims, 6 Drawing Sheets

20
21c
21b
12
40
22
64
24
25a
24b
26
24d
2
24a
26b
21
42
53a
50
51
41
56
52
27
55
32
22b
23
34
35
36
37
21a

FIG-7A
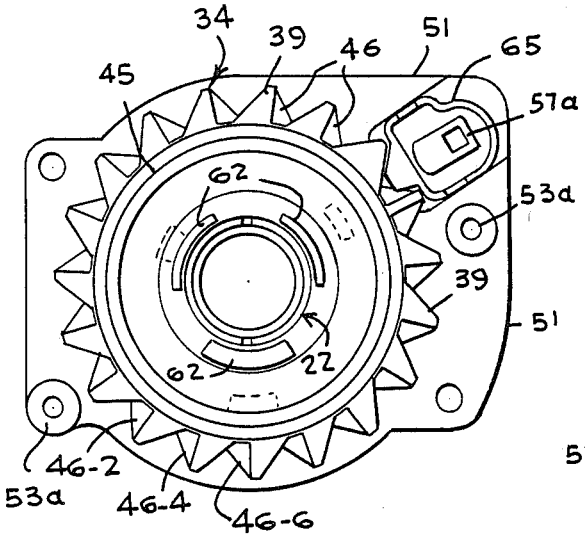
FIG-7B
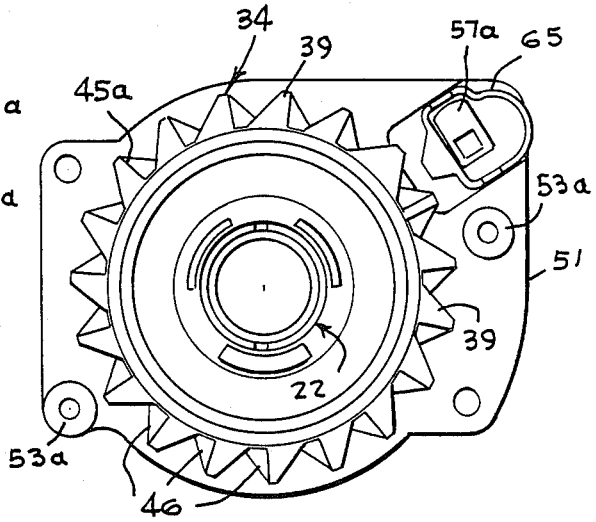
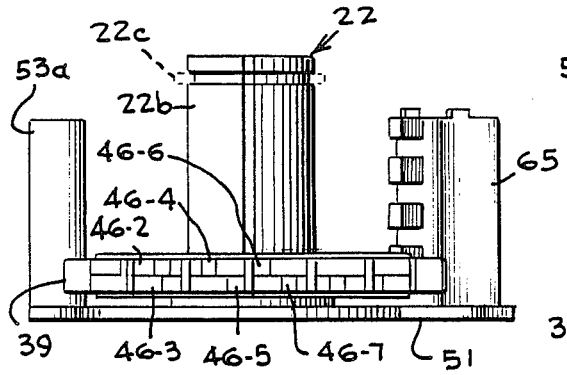
FIG-7A-1
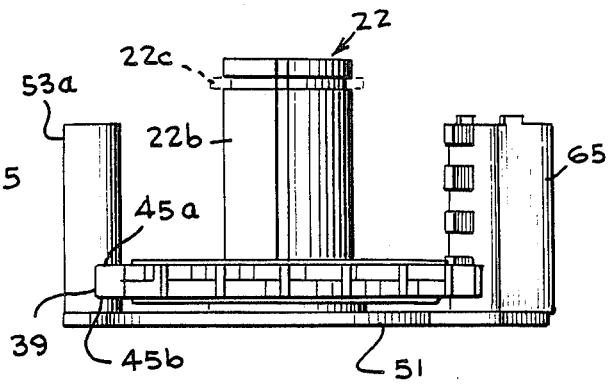
FIG-7B-1

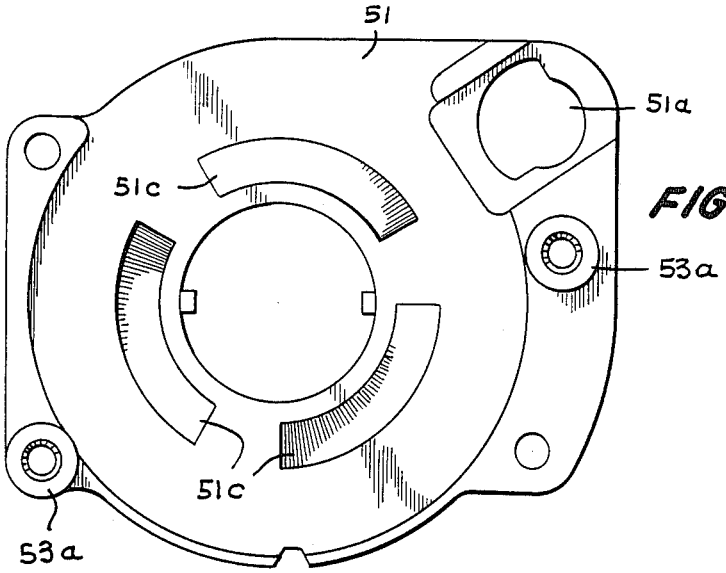
FIG-8A
FIG-10
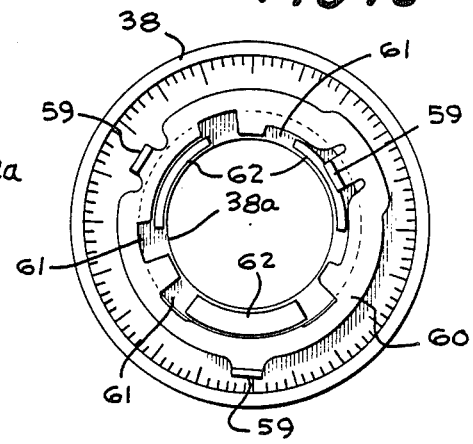
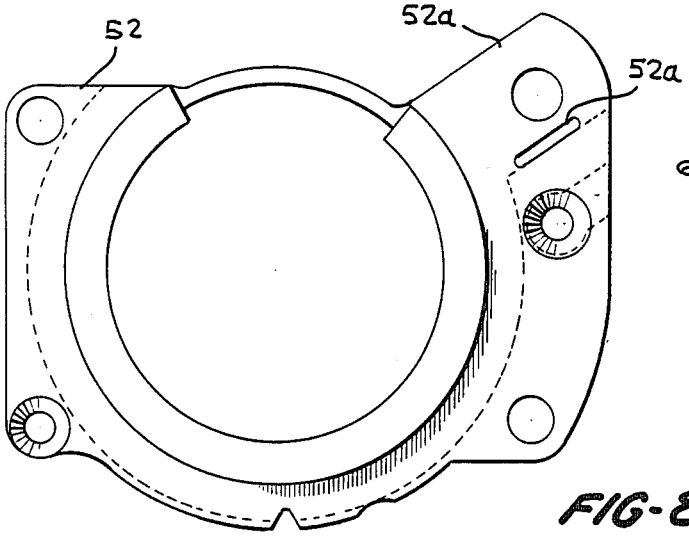
FIG-8B
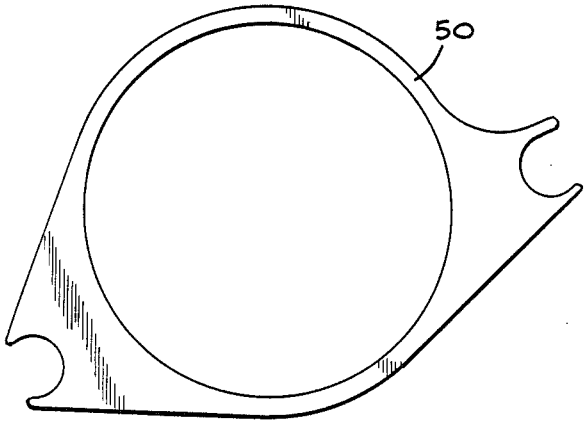
FIG-9

RADIOLOGICAL DETECTION RESISTANT KEY CHANGEABLE COMBINATION LOCK

PRIOR RELATED APPLICATION

The present invention relates to the invention disclosed and claimed in prior related application Ser. No. 1,221 filed Jan. 7, 1987 in the name of Harry C. Miller and Stephen Helasfai.

BACKGROUND AND OBJECTS OF THE INVENTION

The present invention relates in general to combination locks, and more particularly to combination locks especially designed to resist compromise of security by detection of the opening combination of the lock through radiography or high energy radiation techniques.

Locks of the type commonly referred to as combination locks depend for their operation upon the alignment of a plurality of disc-like rotary elements, commonly called tumbler wheels, in a preselected manner to permit retraction of a reciprocative bolt from its projected position. Each tumbler is provided with a peripheral recess, commonly termed a gate, designed to receive a bar or fence normally disposed in overlying relation with the tumbler wheel peripheries and extending from a fence lever which is pivoted or otherwise coupled to a bolt and controls movement of the latter. When the tumbler gates are all disposed in registry with each other and in preselected alignment with the fence, and a driving cam which effects angular adjustment of the tumbler wheels through lost-motion connections and controls the fence lever is adjusted to a selected angular position, the fence may drop into the tumbler gates and permit such an interconnection of the fence lever with the driving cam that limited arcuate movement of the driving cam will impart movement to the fence lever to retract the bolt. The security of such locks is dependent upon the fact that the number of orders or permutations of the possible relative positions of the tumbler gates before all of the tumbler gates come into registry with the fence to permit retraction of the bolt is so large that the chance of these gates being aligned by a person not familiar with the combination is negligible.

In recent years, mechanical arrangements have been devised which are reasonably effective to protect the combination lock against mechanical manipulation thereof by unauthorized persons to surreptitiously detect the combination. However, various techniques have been developed in recent years for compromising the security of combination locks in safes and other security closures by the use of high-energy radiation. These have been variously termed radiography or radiological techniques and in general involve the production of pictures or other types of images of the lock works by photographing high-energy radiation which has passed through the lock mechanism, or by oterwise measuring such radiation emerging at various locations or for various positions of the pack of tumbler wheels. With the developments made in portable radiation sources, unauthorized persons may enter on the premises containing a security container and by radiological methods determine the combination setting of the lock and secure unauthorized entry to the protected enclosure in a short time without leaving any evidence of compromise of the lock combination.

Various arrangements have been devised in an effort to protect combination locks against compromise of the combination by such radiographic techniques, including particularly the provision of radiant energy scattering devices disposed within the lock housing, especially in surrounding relation to the tumbler wheels, to effect scattering of the penetrating radiation and thereby confound the image or photograph produced by radiological techniques. Examples of such radiant energy scattering devices may be found in earlier U.S. Pat. Nos. 2,970,217 and 3,024,640.

Other efforts to avoid detection by such radiographic image techniques attempting to permit observation of the angular locations of the tumbler wheel gates, with or without the presence of such radiation scattering devices, has been to form the tumbler wheels of low density materials such as nylon, rather than the metallic materials conventionally employed, to minimize the production of X-ray or high energy radiation shadows which would reveal the positions of the tumbler wheel gates.

In addition to use of X-ray photography techniques which provide a flat photograph of the wheel pack showing the positions of the gates, neutron beam gauging techniques or related high energy radiation measuring techniques have also been developed to reveal the combination of the lock. In the neutron beam gauging procedure, a neutron beam from an appropriate source is aimed at the edge of the tumbler wheel pack and the location of the gates is indicated on a counting device by a higher count for a set time period, which results from less metal, nylon or other material from which the tumbler wheel is made being in the beam path when the beam passes through a gate.

Some of the techniques developed to attempt to resist attack by such radiation detection procedures have included provision of additional false gates on each of the tumblers in addition to the true gate, to confound the radiological image, or the use of additional false tumbler wheels which indicate additional combination positions other than those for the true gates of the true tumbler wheels. Another technique developed is that disclosed in the Todd U.S. Pat. No. 3,983,727 of Oct. 5, 1976 assigned to the United States of America as represented by the Secretary of the Army, wherein a wheel pack is used in which a novel true-false gate system is provided on the perimeters of the tumbler wheels. The tumbler wheels are provided with a large number of gates about the periphery of each tumbler wheel, the gates being cut in the shape of right triangles and so positioned that the hypotenuse of the triangle on one side of each wheel intersects the hypotenuse of the triangle on the other side of the wheel, and only one of the gates on each wheel is a true gate. The contact portion of the fence associated with these tumbler wheels is designed to only contact one-half of each wheel and is shaped so that it will only fit into a gate whose shape and orientation is identical to the fence. Since all of the gates, whether true or false, have a mirror image gate immediately behind them, they all look the same in the X-ray image or the neutron counter measurement.

While combination locks with the Todd type tumbler wheel construction are effective in resisting radiological detection, the tumbler wheels disclosed in that patent are not of a construction suitable for effecting change of the lock combination. Obviously periodic changing of the combination of the lock by security personnel is a useful and important additional factor in deterring unauthorized opening of the combination lock.

An object of the present invention, therefore, is the provision of a novel combination lock with tumbler wheels having hub portions or wheel centers and rim portions or wheel cases, capable of being changed in their relative angular positions to each other circumferentially of each tumbler wheel to change the lock combination, and wherein the tumbler wheel gate arrangement provides true and false gates resistant to radiation detection, and the tumbler wheels are not provided with any change key holes in the wheel or gate configurations which could be detected radiographically.

Another object of the present invention is the provision of a novel radiographic detection resistant combination lock construction as described in the immediately preceding paragraph, wherein novel means are provided to effect axial movement of the wheel centers or hub portions of the tumbler wheels making up the wheel pack is effected by means which avoid the use of a change key which would require change key holes in the tumbler wheel centers or hub portions to resist radiographic detection of tumbler wheel position by detection of key change wheel openings.

Still another object of the present invention is the provision of such a combination lock construction wherein novel means are provided to restrain the tumbler wheel cases or rim portions against movement during combination change movement of the tumbler wheel centers or hub portions without revealing the position of the true gates of the tumbler wheels.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIGS. 7A, 7A-1 and 7B, & B-1, are top plan views and rear elevational views of the bottom plate and secondary fence, a tumbler wheel and the tumbler post, for change mode and operation mode conditions respectively, of the lock;

FIG. 8A and 8B are rear elevational views of the bottom plate and top plate, respectively, of the tumbler wheel assembly;

FIG. 9 is a rear elevational view of one of the intermediate spacers provided between successive tumbler wheels;

FIG. 10 is a rear elevational view of one of the tumbler wheel centers and an associated fly member;

DETAILED DESCRIPTION OF PREFERRED EMBODIMENTS

Figures 1, 2:
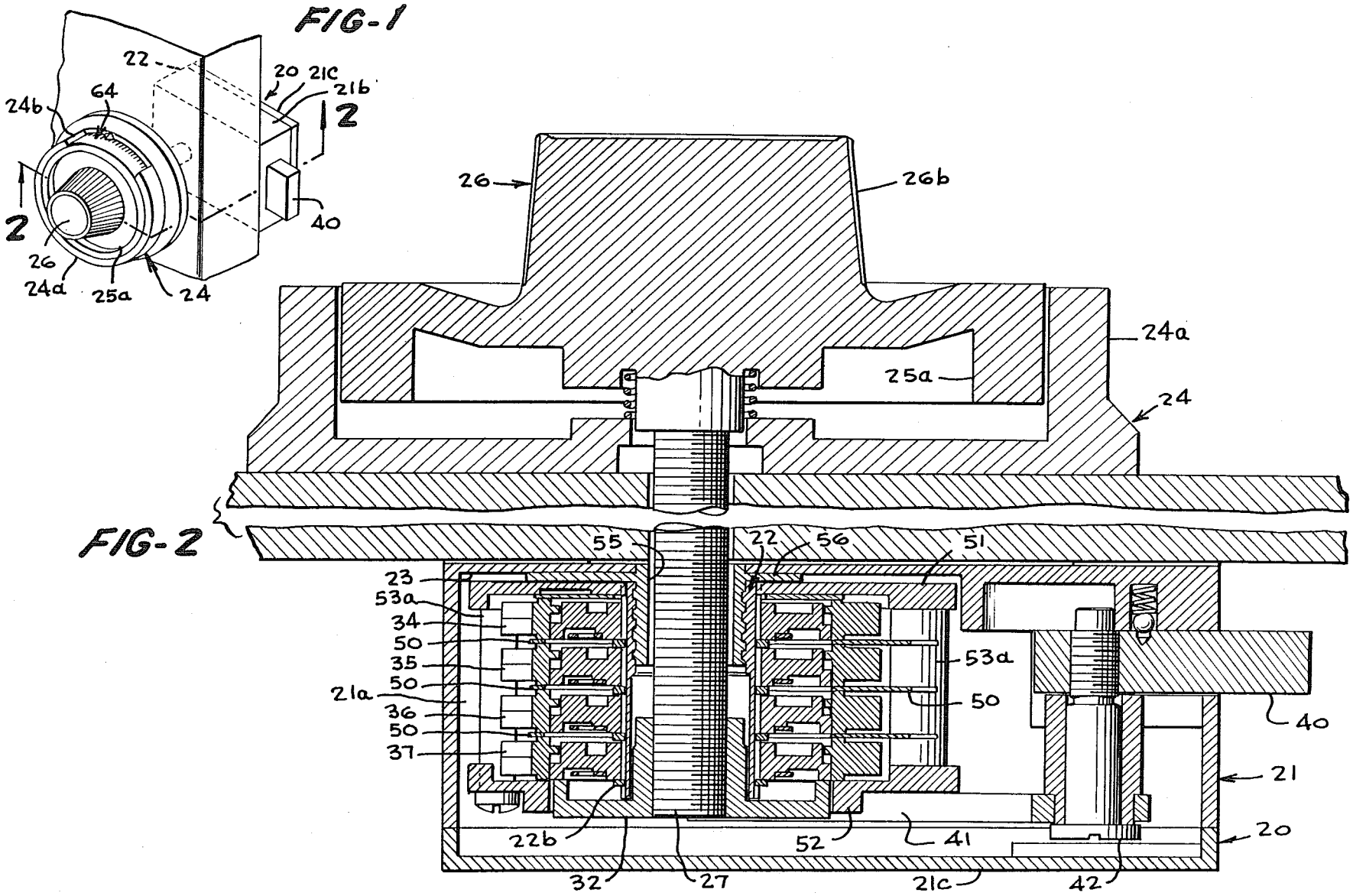
FIG. 1 is a perspective view of a combination lock constructed in accordance with the present invention.
FIG. 2 is a horizontal longitudinal sectional view of the combination lock, taken along the line 2—2 of FIG. 1.
Figure 3:
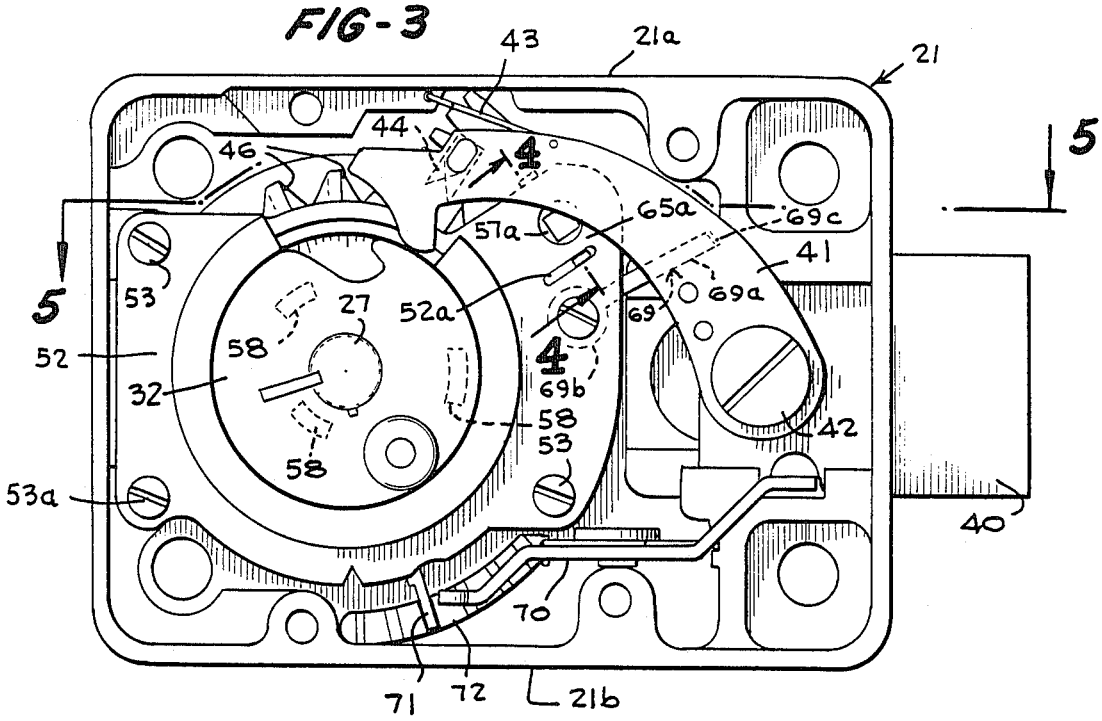
FIG. 3 is a rear elevation view of the combination lock with the rear cover removed, showing the lock in locked condition.
Figure 5:
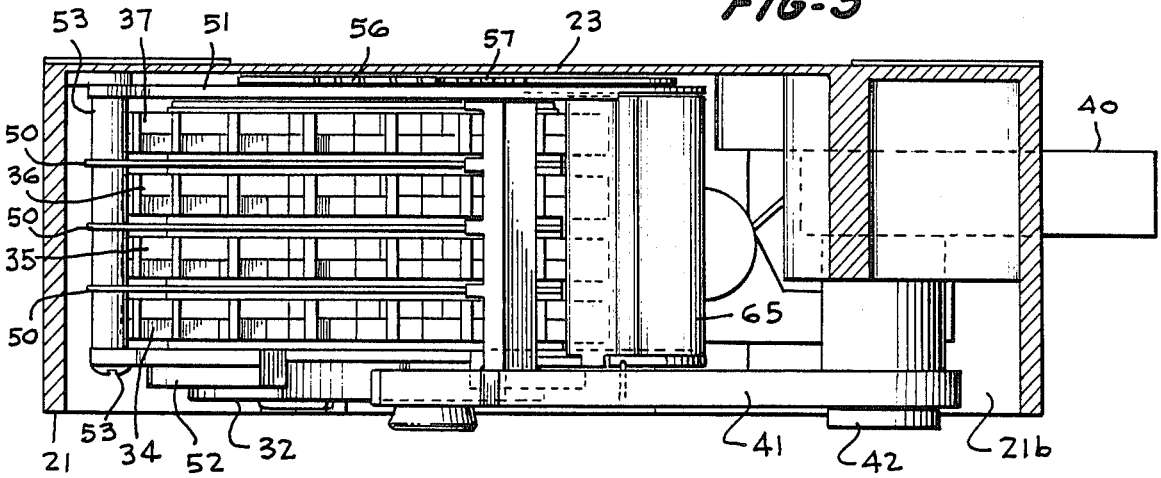
FIG. 5 is a horizontal longitudinal sectional view taken along the line 5—5 of FIG. 3.
Figure 4:
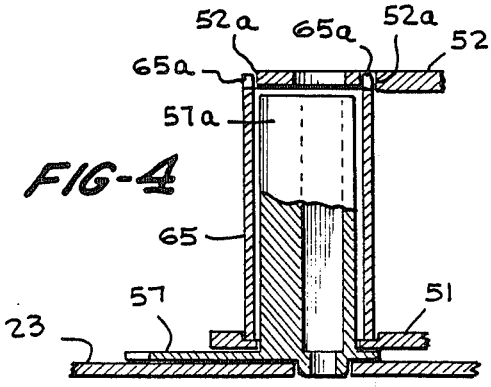
FIG. 4 is a fragmentary vertical sectional view through the change key operated gear and change fence and adjacent parts of the top and bottom plates, taken along the line 4—4 of FIG. 3.
Figure 6:
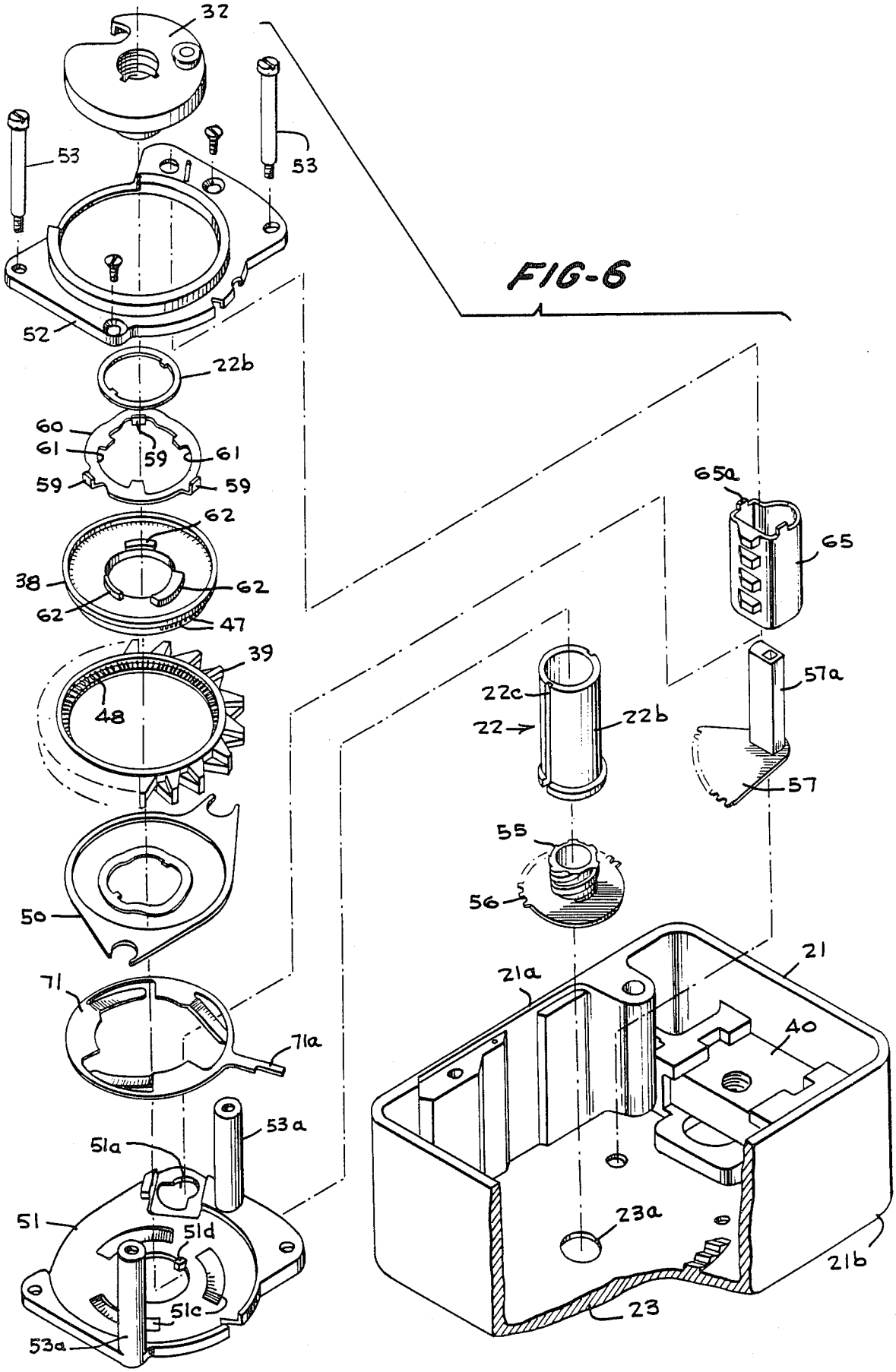
FIG. 6 is a perspective view, with part of the lock case shown in section of the support plates, and secondary fence, with the tumbler wheels and associated spacers and fly members removed.

Referring to the drawings, wherein like reference characters designate corresponding parts throughout the several figures, there is illustrated in FIGS. 1–13 a combination lock generally indicated by the reference character 20, which includes a substantially rectangular lock case 21 having top and bottom walls **21*a*, 21*b* and means rotatably supporting a hollow tubular tumbler post assembly 22, of special construction as hereinafter described, for rotary and axial movement, which projects rearwardly relative to the front wall 23 of the lock case. A removable rear cover plate 21*c* is provided to close the rear of the lock case. The lock case 21 is designed to be mounted against the inner surface of a safe door, file cabinet door or other security closure in the conventional manner as by mounting screws extending through screw holes near the corners of the lock case and into the supporting door, file cabinet front wall or the like. Secured to the outer face of the supporting door or mounting wall concentric with the axis of the tumbler post assembly 22 is a dial ring 24, here shown as having a cylindrical shield 24*a* surrounding and shielding from view the major portion of the peripheral flange 25*a* of the dial portion 25 of the dial and knob member 26, the shield 24*a* being interrupted by a sight opening 24*b*** of suitable circumferential extent.

The dial and knob member 26 is supported for rotation within the forwardly opening cylindrical well of the dial ring 24 defined by the shield **24*a*, and includes a drive spindle 27 coupled at its outermost end to the dial and knob member 26 and extending through the hollow tumbler post assembly 22 on the front wall of the lock case 21, to be rotatably journaled by the tumbler post assembly and supported at the desired position. The dial and knob member 26 has an integral knob portion 26*a* thereon which projects forwardly from the dial portion 26 and preferably has a knurled periphery to facilitate manipulation of the dial and knob member 26**.

The threaded rearmost end of the drive spindle 27 receives an internally threaded portion of a tubular boss formation **32*a* projecting forwardly integrally from the driving cam 32. The driving cam 32 is keyed to the drive spindle 27 at the desired angular position by inserting a suitable spline key into the radial groove in the center bore of the drive cam which is aligned radially with a kerf in the spindle 27 to interlock these components against further relative rotation. A stack or array of a plurality of tumbler wheels, for example a four wheel stack or a three wheel stack, here shown as a four wheel stack, indicated by the reference characters 34, 35, 36 and 37, of special construction hereinafter described, are supported to rotate freely upon the cylindrical surface 22***a* of the hollow tumbler post assembly 22 extending rearwardly from the front wall of the lock case 21. It will be appreciated, of course, that a three tumbler wheel stack, or a stack of any other number of tumbler wheels may be used.

Each of the tumbler wheels 34, 35, 36 and 37 have an inner hub or wheel center portion 38 provided with a center opening 38*a* for journalling the tumbler wheel on the cylindrical post assembly 22 and have an outer rim or "wheel case" portion 39, which is interrelated in a special way with the wheel center or hub 38 of the associated tumbler wheel to permit combination change of the tumbler wheels in a novel way and resist radiographic detection.

The lock is also provided with the usual bolt 40 which is adapted to slide in a suitable guideway formed in one end of the lock case 21. The bolt 40 is operated by means of a fence lever 41 which is pivotly attached to the bolt by means of a screw 42. The fence lever 41 is normally resiliently urged to the elevated position illustrated in FIG. 3 by a lever spring such as the spring 43 having, for example, one end received in the fence lever 41 and another end inserted in a hole in a stationary portion of the lock casing to resiliently urge the fence lever to rotate to the raised position. The fence lever 41 is provided with a laterally projecting bar 44, commonly referred to a fence, which is of special configuration coactive with the configuration of the peripheries of the wheel case or rim portions 39, which projects along an axis parallel to the axis of the drive spindle 27 and overlies the peripheries of all of the tumbler wheels 34, 35, 36 and 37.

The outer wheel case or rim portions 39 of the tumbler wheels contain a specially shaped periphery defining a plurality of gates, only one of which is a true gate, in accordance with the principles disclosed in earlier U.S. Pat. No. 3,983,727 to Orin Todd, granted Oct. 5, 1976. Generally speaking, each wheel case or rim portion 39 includes an annular main body portion 45 having a shaped inwardly and outwardly directed faces 45*a*, 45*b* provided with tooth-like formations providing a plurality of gates, generally indicated at 46, extending circumferentially throughout the periphery of the wheel case with half of the gates on each wheel case or rim portion 39 being cut half way through one side of the wheel case and the other half of the gates being cut half way through the other side of the wheel case. All of the gates 46 are cut in the shape of a right triangle and are so positioned around the outer perimeter of each wheel case 39 that the hypotenuse of a triangle on one side of each wheel intersects the hypotenuse of a triangle on the other side of that wheel case.

Similarly, the fence 44 of the fence lever 41 which must drop into a gate on each wheel case 39 to permit opening of the lock by withdrawal of the lock bolt 40 is specially shaped with adjacent pairs of shaped triangular fence teeth, such as teeth 44*a*, 44*b*, arranged in immediately adjacent pairs and directed in oppositely inclined relations to interfit into the shaped gates 46 of the tumbler wheel case portions 39 so that they will only contact one-half of each wheel case 39 and will only fit into a gate identical in shape and orientation to the aligned fence tooth. There is only one gate on each wheel case that meets this requirement, and thus there is only one true gate on each wheel tumbler, while the rest of the gates form false gates. However, since all the gates, whether true or false, have a mirror image gate immediately behind them, they all look the same on a flat X-ray plate or to a neutron beam counter recording the strength of a gamma neutron source, so that it is not possible to distinguish the true gates from the false gates using X-ray or neutron gauging techniques.

More specifically, as shown in FIGS. 7A and 7A-2, the gates 46 are cut in the front and back half, in faces 45*a*, 46*b* of each wheel case or rim portion 39 and are so positioned relative to each other to form gate pairs 46-2, 46-3, or 46-4, 46-5, or 46-6, 46-7, as typical examples with the hypotenuse of the triangle of a gate on one side, for example 46-2, 46-4 or 46-6, intersecting the hypotenuse of the triangle of a gate on the other side, for example 46-3, 46-5, or 46-7. While the specific number of gates is not critical, it is obvious that the total number of gates will always be an even number since the gates in the back and front form gate pairs.

Only one of the gates 46 is a true gate, as the rest are false gates. The hypotenuse of the true gate goes from the edge of the wheel case 39 in an inwardly slanting direction whereas the hypotenuse of each of the other triangular gates 46-2, 46-4, and 46-6 for example, on the related side of the wheel case, going from the edge of the wheel case inwardly slant to the left. The hypotenuse of the triangle of each of the gates 46-3, 46-5, 46-7 and so on on the other side of the wheel case, for example, the rear side, all slant in the opposite direction fromthe hypotenuse of the triangle of gates 46-2, 46-4, 46-6, etc., and thus each of the gates has a mirror image gate behind it.

Figure 11A:
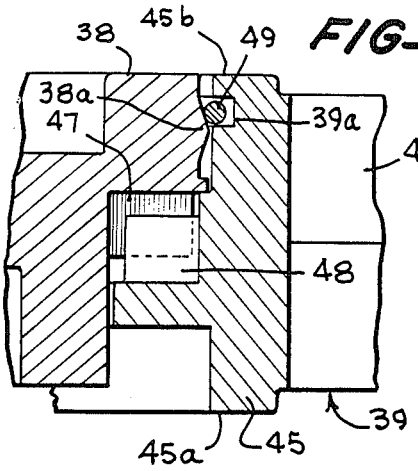
FIGS. 11A and 11B are enlarged fragmentary section views of adjacent portions of the tumbler wheel rim members and centers and the hub encircling spring associated therewith, shown in locked position and unlocked position respectively.
Figure 11B:
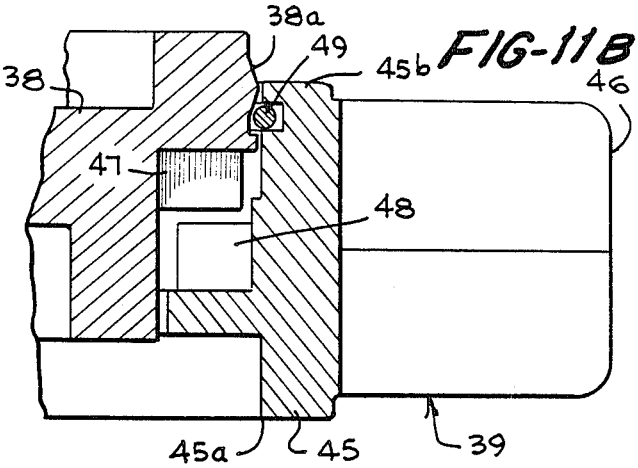
Figure 12:
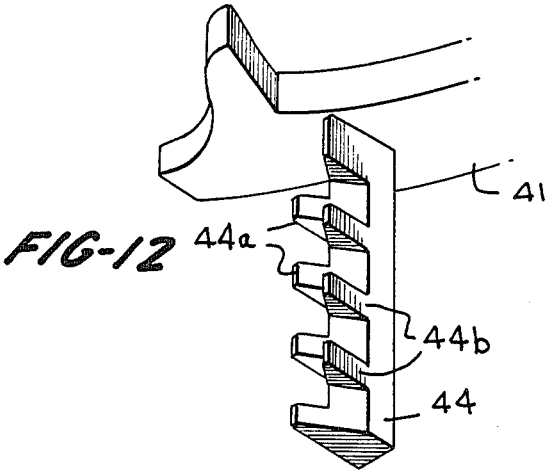
FIG. 12 is a fragmentary perspective view of the lower tooth formation portion of the primary fence on the fence lever.
Figure 11C:
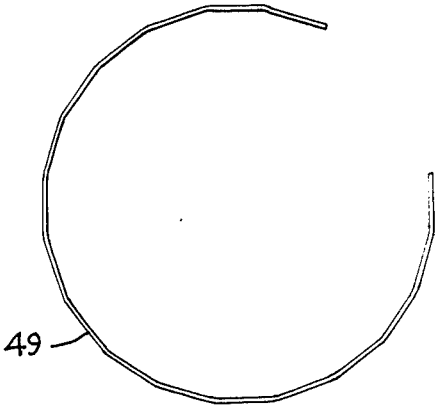
FIG. 11C is a fragmentary elevational view of the spring of FIG. 11A.
Figure 13:
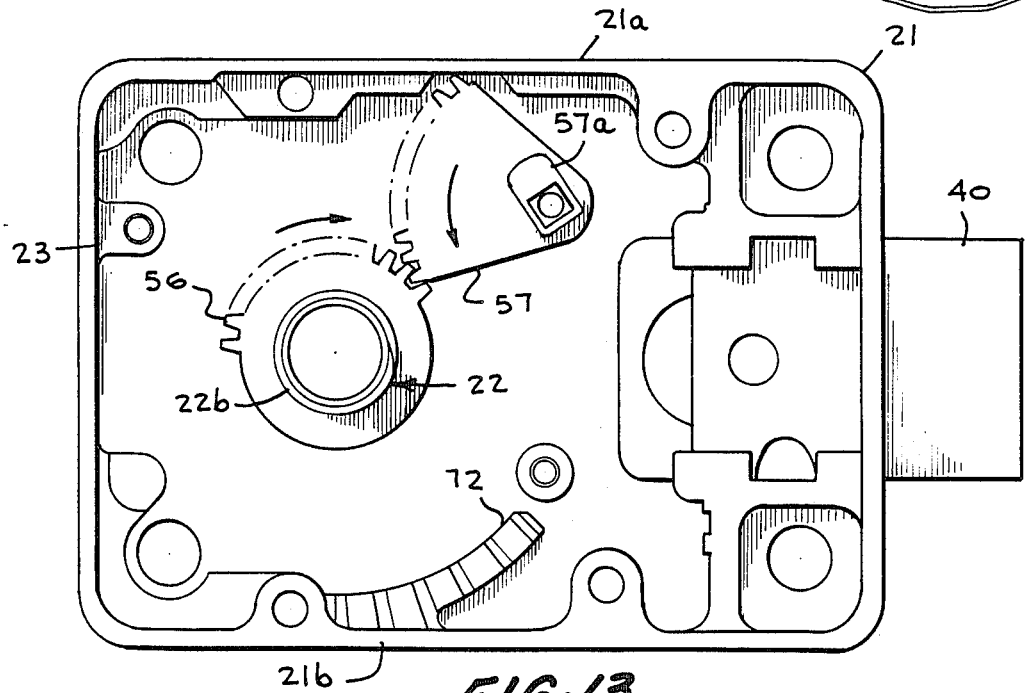
FIG. 13 is a diagramatic rear elevational view showing the lift post member, the lift-post-moving gear member and sector gear member and the change fence actuator with the wheel pack, plates and other components removed to reveal these components.

The wheel case or rim portions 39 of the tumbler wheels 34, 35, 36 and 37 and the inner hub or wheel center portions 38 thereof are provided with interfitting teeth 47, 48 designed to interfit when the wheel and center portions 39, 38 are in the aligned or locked positions shown in FIG. 11A and to be disenaaged when they are axially displaced relative to each other to the unlocked positions shown in FIG. 11B. The inner diameter or center opening surface of the wheel case members 39 are also provided with a retaining groove 39*a* designed to receive a spring wire 49 which forms a polygon with a large number of sides, a part of this spring wire retainer 49 remaining exposed outside the retaining groove 39*a* to allow for an interference fit with a ramp formation 38*a* on the wheel center members 38. This interference produced between the spring wire retainer 49 and the ramp formation 38*a* of the wheel centers 38 controls the ability of the wheel center 38 to move in or out with respect to the wheel case or rim portion 39. The wheel center portions 38 are moved by applying a force sufficient to elastically deform the spring wire retainer 49 upon movement of the tumbler post assembly 22 axially to shift the wheel centers from the FIG. 11A locked position to the FIG. 11B unlocked position when it is desired to change the combination of the lock.

The pack of tumbler wheels 34–37 are assembled together between bottom and top plate members 51, 52 and intervening spacers 50 fixed by spacer posts 53*a* fixed to the bottom plate 51 and mounting bolts 53 threaded into the case wall 23 with the wheel case or rim portions 39 of the tumbler wheels 34–37 retained against axial movement by wheel spacers 50, (shown in FIG. 9) and by the bottom plate 51 and top plate 52, (shown in FIGS. 8A and 8B), assembled together in a modular arrangement as shown. The wheel spacers 50 are provided with center openings of slightly larger diameter than the tumbler wheel centers 38 to permit relative axial movement of the tumbler wheel centers 38 with respect to the tumbler wheel rim or case portions 39, while the spacers 50 and top and bottom plates 52, 51 restrain the wheel case or rim portions against axial movement. The spacer posts 53*a* and screws 53 are located outwardly of the peripheries of the tumbler wheels 34–37 so that the tumbler wheels are free to rotate upon rotation of the dial and knob member 26.

The tumbler post assembly 22 provides the means for moving the wheel centers or hubs 38 axially in a direction to disengage their teeth 48 from the teeth 47 of the wheel rim or case portions 39, and comprises an axially moveable hollow tubular wheel post member 22*b* having a shoulder flange or collar 54 near its forward end adjacent the front wall 23 of the lock case forming a lift shoulder movable in the opening of the bottom plate 51 between the nearest tumbler wheel 34 and a gear member 56 for axially moving the member 22*b* to move the flange 54 against the confronting surface of the wheel center or hub portion 38 of the nearest tumbler wheel 34. The wheel post member 22*b* has an internally threaded bore portion which is threaded onto the threaded stub shaft portion 55 of a gear member 56 having a short forwardly projecting cylindrical tubular portion 56*a* journaled in the opening 23*a* in the front wall 23 of the lock case, through which the spindle 27 also extends. The movable wheel post member 22*b* also includes a pair of diametrically opposite slots 22*c* to receive diametrically opposite lugs 51*d* projecting inwardly from the center opening of the bottom plate 51 restraining the post member 22*b* against rotation while allowing axial movement thereof as the gear member 56 is rotated.

The gear member 56 serves to axially move the wheel post member 22*b* by interengaging threads and is rotated by a change key gear member 57 having rectangular actuator bar formation 57*a* fixed thereon with a downwardly projecting portion journaled for rotation in opening 51*a* in the bottom plate 51. The change gear member 57 with its actuator bar formation 57*a* has a hollow opening therethrough of square or other appropriate configuration to receive and be operated by a change key of typical non-round cross-section as later described, and is at a location spaced outwardly from the periphery of the tumbler wheels 34–37. Thus there is no change key opening in the tumbler wheels, such as are present in conventional combination locks, by which radiological images or measurement may be made identifying tumbler wheel change key openings signifying angular positions of the wheels. The rectangular actuator bar 57*a* is fixed on the change key sector gear member 57 rotatable within a shaped hollow change fence 65 slidable radially of the tumbler wheels to shift the fence 65 into and out of the true gates of the tumbler wheels at the change mode position.

Movement of the wheel center lift post member 22*b* and the engagement and disengagement of the wheel case and wheel center teeth 47, 48 is achieved by rotation of the change key gear sector member 57 through a suitable angle, causing rotation of the gear member 56 and the male threaded portion 56*a* of the gear member 56, within the female threaded portion of the wheel center lifting post member 22*b*. This produces axial translation of the lifting post member 22*b* and its shoulder flange 54 rearwardly through the bottom plate opening, thus forces the tumbler wheel centers 38, the forwardmost of which bears against the lift flange 54, axially rearwardly from the FIG. 11*a* position to the FIG. 11*b* position to disengage their teeth 47, 48 so that relative rotation of the wheel centers 38 relative to the tumbler wheel case or rim portions 39 can be achieved to effect combination change. The wheel centers 38 are returned forwardly to the normal interlocking relation with the rims 39 upon return of the post member 22*b* forwardly by rotation of gear member 56 as the washer 22*c* in a groove near the rearmostend of the post member 22*b* engages the rearmost tumbler wheel center and moves all the centers forwardly.

The tumbler wheels 34–37 are driven from the driving cam 32, spindle 27, and the dial and knob member 26 which operates the spindle 27, by means of a novel driving pin and fly arrangement, wherein the driving cam has three driving pins 58 arranged at three equal circumferentially spaced angles spaced different radial distances form the cam center, and engaging three rearwardly projecting lugs 59 projecting from a generally circular fly 60 seated in a rearwardly facing recess or well in the hub portion or wheel center 38 of the rearmost tumbler wheel 34 and similarly spaced different radial distances from the the center axis of the wheel centers to be engaged by a different respective one of the drive pins. The fly 60, provides the usual lost motion coupling which is well known in tumbler wheel type combination locks by having arcuate recesses 61 at three equally spaced circumferential locations which receive similarly shaped, but circumferentially shorter arcuate projections 62 extending from the wheel centers 38 of the forwardly adjacent tumbler wheels and received in the recesses 61. A set of three forwardly projecting drive pin lugs 63 extend forwardly from the opposite face of each wheel center 39 to engage the fly lugs 59 of the fly 60 on the next forwardly adjacent tumbler wheels 35, 36 or 37 to achieve the usual lost motion coupling drive upon appropriate rotation of the driving cam 32. This fly arrangement, employing three drive projections or drive pins and three fly lugs to be engaged thereby, instead of the usual drive pin and single fly lug on the fly, is an improvement over the conventional single point drive providing for balanced forces, greater accuracy, and greater resistance to wear.

To effect changing of the combination, the existing opening combination is first dialed with respect to a combination change index reference, for example as indicated at 64, rather than the normal dialing reference index. The secondary or combination change fence 65, positioned by the actuator bar 57*a* on the gear sector member 57 and rotatable therewith, has teeth 67 similar to the teeth 44*a* or 44*b* of the normal dialing fence 44 to interfit with the true gates 46 defined by the right triangular tooth formations on the perimeters of the wheel case or rim portions 39 when the proper opening combination has been dialed with respect to the change index mark 64. The combination change fence 65 has a shaped hollow cavity extending therethrough receiving the actuator bar 57*a* fixed to the change key gear sector member 57 and is guided for radial sliding movement by shallow wells or recesses in the top and bottom plates 52, 51 and by short lugs 65*a* protruding into guide slots or surfaces 52*a* in the top plate, so that, upon insertion of the change key, through the change key opening 68 in the rear cover of the lock case and through the non round opening in the actuator 57*a* and gear sector 57, rotation of the change key through about 90° rotates the actuator bar 57*a* to shift the change fence 65 radially inwardly to interengage its teeth 67 in the true gates of the tumbler wheel case or rim portions 39 during initial movement of the change key. During the remainder of movement of the change key, the change key gear sector member 57 drives the gear member 56 through an appropriate arc to cause the tubular lift post member 22*b* to move rearwardly sufficiently to force the wheel centers 38 rearwardly relative to the wheel case or rim portions 39 held by the wheel spacers and bottom and top plates 50, 51 and 52 and disengage the teeth 47, 48 of the wheel cases 39 and centers 38.

The new or changed combination of the lock can then be dialed in the usual manner, causing the wheel centers 38 to be rotated to the new combination positions relative to their associated wheel cases 39 by the action of the driving cam 32 and its drive pin formations, and the flies 60 and associated lost motion coupling structure of the flies 60 and wheel centers 38, while the wheel case or rim portions 39 are held against rotation by the combination change fence 65. Upon completion of dialing of the new combination, the change key is then rotated back to its initial insertion position, causing rotation of the change key gear member 57 and gear member 56 to cause the tubular lift post member 22*b* to return to its normal position and, through engagement of the washer 22*c* with the rearmost tumbler wheel center 38 of tumbler 39, returning the wheel centers 38 forwardly relative to the wheel case or rim portions 39 to reengage their teeth 47, 48 and couple them in the new combination position. During the latter part of the rotation of the gear member 57 and its associated actuator bar 57*a*, the chance fence 65 is retracted to a position withdrawing its teeth from the true gates of the tumbler wheels.

Once the combination has been set by the above described procedure, the combination lock is operated in the normal manner to open the lock in accordance with the new combination which has been set, by rotating the dial and knob member 26 first in one direction for more than four complete turns to bring the first number of the combination as indicated on the flange 25*a* of the dial portion 25 into alignment with the normal dialing stationary index mark on the dial ring 24, during which the three drive pins which are circumferentially spaced and of different radial spacings from the center of the drive cam 32 engage the fly drive lugs 59 associated with the rearmost tumbler wheel 34 and rotate that fly 60 through the lost motion arc permitted by the recesses 61 to then commence rotating the associated tumbler wheel 34. In similar fashion, through interaction of the driving pins 63 of wheel 34 with the fly drive lugs 59 associated with the next tumbler wheel 35, the tumbler wheel 35 is rotated and, through successive revolutions, rotation of the tumbler wheel 36 and then the tumbler wheel 37 is achieved to locate wheel 37 at its proper combination position. Rotation of the dial and knob member 26 in the opposite direction through more than three revolutions to the next combination position similarly effect positioning of the tumbler wheel 36, and rotation of the knob again in the cpposite direction through more than two rotations effect adjustment of the tumbler wheel 35 to the proper position followed by final rotation of the dial again in the opposite direction to properly position the tumbler wheel 34. Upon return of the dial to the zero or opening position, the fence lever 41 is allowed to fall by registry of the gate of the driving cam with the nose of the fence lever, permitting the fence 44 to be lowered to a position inserting its tooth formations 44*a* into the properly aligned true gates on the rim portion of the tumbler wheels. A fence lever hold-down leaf spring member 69 having an elongated arm 69*a* extending from a circular fixed end 69*b* secured by one of the spacer posts 53*a* and screws 53 has an inclined restraining tip 69*c* to catch the top of the fence lever 41 when its nose seats in the driving cam gate and resiliently retains the lever 41 in lowered position while rotation of the dial 26 and driving cam 32 moves the fence lever toward the vertical wall opposite the wall through which the bolt 40 projects, retracting the bolt 40 to the unlocked position. Return rotation of the dial and knob member 26 in the opposite direction causes the fence lever nose to be cammed up out of the driving cam gate forcing the lever 41 to be released from the restraining force of the leaf spring tip 69*c* while projecting the bolt 40 to the locking position. Further rotation of the dial and knob member through more than four revolutions insures scrambling of the tumbler wheels 34–37 to random nonaligned positions.

While provision is made in the preferred embodiment to the usual lockout mechanism, indicated generally at 70 which locks the bolt 40 against retraction from the projected position if the rear cover 21 is removed for any reason, as by attempting to drive the spindle rearwardly from the lock case, and a torque adjuster spring formation 71 may be interposed between the forwardmost tumbler wheel and the bottom plate 51 to coact with ramp formations 51*c* on plate 51 and have an arm 71*a* positioned along locating teeth 72 on the case, these form no part of the present invention and detailed description of them is unnecessary, as the lockout is conventional and the torque adjuster is disclosed in prior U.S. Pat. No. 4,163,376.

We claim:

1. A combination lock of the type adapted for changing of the combination by a change key, comprising a lock case having front and rear walls and a cylindrical tumbler post normally extending along a horizontal axis rearwardly from said front wall, a tumbler wheel stack formed of a plurality of tumbler wheels loosely journaled on the tumbler post for rotation about the axis thereof and each including an annular outer rim portion and an inner annular hub portion having formations about its periphery releasably intercoupling the hub portion and rim portion at any of a plurality of relative angular positions, a peripherily gated rotatable driving cam driven by a rotatable dial, means for driving the tumbler wheels responsive to rotation of the dial and driving cam, a fence lever pivotally connected to a bolt for shifting the bolt between locked and unlocked positions, the rim portions of said tumbler wheels having peripheral gates therein to receive therein confronting portions of a fence on said fence lever when the tumbler wheels are properly aligned following dialing of the proper lock opening combination, said rear wall of the lock case having an opening therein for insertion of a combination change key into the lock case and rotation thereof at a position located radially outwardly of the tumbler wheels adjacent the outer peripheries thereof, means supporting said tumbler post within the tumbler wheel hub portions for nonrotatable axial movement between first and second positions and having shoulder means forwardly and rearwardly abutting the wheel hub portions of the tumbler wheel stack for movement of the hub portions axially relative to said outer rim portions between coupled and decoupled relation therewith, restraint means restraining said outer rim portions against axial movement, and tumbler post positioning means within the lock case activated by rotation of the change key within the lock case between coupled and decoupled positions for axially moving the tumbler post and said tumbler wheel hub portions to shift the tumbler wheel hub portions to decoupled and recoupled relation with the tumbler wheel rim portions for combination change by rotation of the hub portions to new combination positions relative to their rim portions responsive to rotation of the dial and driving cam to a new changed lock opening combination, and rim portion holding means comprising a secondary change fence member moveable into inserted relation in the gates of said tumbler wheel rim portions and retractable therefrom to hold the rim portions against rotation during such combination change, said secondary change fence being located in radially outwardly spaced relation to and adjacent the peripheries of said tumbler wheel rim portions, and means for supporting and guiding the secondary change fence member for rectilinear translation movement toward and away from the tumbler wheels along a rectilinear path extending radially of the tumbler wheels.

2. A combination lock as defined in claim 1, including rim portion holding means associated with said tumbler post positioning means moveable concurrently with movement of the latter responsive to rotation of the change key to decouple and recouple positions to respectively engage and hold the tumbler wheel rim portions against rotation while the tumbler wheel hub portions are being decoupled and intercoupled with their respective rim portions and while they are in decoupled relation.

3. A combination lock as defined in claim 1 wherein said tumbler post positioning means comprises a lag screw member journaled for rotation adjacent the front wall of the lock case in coaxial relation to and extending into the tumbler post and the tumbler post having a threaded bore receiving the lag screw member in threaded relation therewith for axially movement of the tumbler post relative to the lag screw member between hub portion coupling position and the hub portion decoupling position relative to the tumbler wheel rim portions, and the tumbler post positioning means including means for rotating the lag screw member responsive to rotation of the change key between the couple and decouple positions.

4. A combination lock as defined in claim 2 wherein said tumbler post positioning means comprises a lag screw member journaled for rotation adjacent the front wall of the lock case in coaxial relation to and extending into the tumbler post and the tumbler post having a threaded bore receiving the lag screw member in threaded relation therewith for axially movement of the tumbler post relative to the lag screw member between hub portion coupling position and the hub portion decoupling position relative to the tumbler wheel rim portions, and the tumbler post positioning means including means for rotating the lag screw member responsive to rotation of the change key between the couple and decouple positions.

5. A combination lock as defined in claim 3, wherein said lag screw member includes a lag screw portion threaded into the bore of the tumbler post and a gear portion located outwardly adjacent the proximal end of the tumbler post and said tumbler post positioning means including a gear formation and a portion thereof receiving the change key having gear teeth intercoupled with gear teeth of the gear member for rotating the lag screw member to position the tumbler post.

6. A combination lock as defined in claim 4, wherein said lag screw member includes a lag screw portion threaded into the bore of the tumbler post and a gear portion located outwardly adjacent the proximal end of the tumbler post and said tumbler post positioning means including a gear formation and a portion thereof receiving the change key having gear teeth intercoupled with gear teeth of the gear member for rotating the lag screw member to position the tumbler post.

7. A combination lock as defined in claim 5, wherein said gear formation has a change fence actuator extending therefrom rotatable with the gear formation responding to rotation of the change key and engaging said secondary change fence to move the secondary change fence into an inserted holding relation with the tumbler wheel rim portion gates and for retraction of the same therefrom.

8. A combination lock as defined in claim 6, wherein said gear formation has a change fence actuator extending therefrom rotatable with the gear formation responding to rotation of the change key and engaging said secondary change fence to move the secondary change fence into an inserted holding relation with the tumbler wheel rim portion gates and for retraction of the same therefrom.

9. A combination lock as defined in claim 1, wherein the outer rim portions of each of said tumbler wheels has a center opening having a diameter corresponding substantially to the outer diameter of the center hub portion and said center opening of the rim portion and the outer perimeter of said hub portion having confronting substantially cylindrical surfaces adapted to releasably abut each other with the rim and hub portions in coplanar alignment and interrupted by tooth formations on each of the hub and rim portions to interfit with each other restraining the associated hub and rim against relative rotation when in the coplanar normal operating position, the surface of the perimeter of each hub portion having a generally triangular ramp formation encircling the hub portion and the confronting portions of the center opening surface of the associated rim portion having a circular recess therein receiving a spring member encircling the confronting hub portion and destorted from circular configuration to project portions thereof from said recess into engagement with the confronting perimeter surface of the associated hub portion, the spring member engaging and being disposed adjacent one inclined surface of the ramp formation when the hub and rim portions are in normal operating, coplanar interlocked position and being distorted by the ramp formation upon movement of the associated hub portion to combination change position displaced from the plane of the associated rim portion to engage an opposite inclined portion of the ramp formation and resiliently restain the associated hub and rim portions in the combination change position.

10. A combination lock as defined in claim 2, wherein the outer rim portions of each of said tumbler wheels has a center opening having a diameter corresponding substantially to the outer diameter of the center hub portion and said center opening of the rim portion and the outer perimeter of said hub portion having confronting substantially cylindrical surfaces adapted to releasably abut each other with the rim and hub portions in coplanar alignment and interrupted by tooth formations on each of the hub and rim portions to interfit with each other restraining the associated hub and rim against relative rotation when in the coplanar normal operating position, the surface of the perimeter of each hub portion having a generally triangular ramp formation encircling the hub portion and the confronting portions of the center opening surface of the associated rim portion having a circular recess therein receiving a spring member encircling the confronting hub portion and destorted from circular configuration to project portions thereof from said recess into engagement with the confronting perimeter surface of the associated hub portion, the spring member engaging and being disposed adjacent one inclined surface of the ramp formation when the hub and rim portions are in normal operating, coplanar interlocked position and being distorted by the ramp formation upon movement of the associated hub portion to combination change position displaced from the plan of the associated rim portion to engage an opposite inclined portion of the ramp formation and resiliently restrain the associated hub and rim portions in the combination change position.

11. A combination lock as defined in claim 3, wherein the outer rim portions of each of said tumbler wheels has a center opening having a diameter corresponding substantially to the outer diameter of the center hub portion and said center opening of the rim portion and the outer perimeter of said hub portion having confronting substantially cylindrical surfaces adapted to releasably abut each other with the rim and hub portions in coplanar alignment and interrupted by tooth formations on each of the hub and rim portions to interfit with each other restraining the associated hub and rim against relative rotation when in the coplanar normal operating position, the surface of the perimeter of each hub portion having a generally triangular ramp formation encircling the hub portion and the confronting portions of the center opening surface of the associated rim portion having a circular recess therein receiving a spring member encircling the confronting hub portion and destorted from circular configuration to project portions thereof from said recess into engagement with the confronting perimeter surface of the associated hub portion, the spring member engaging and being disposed adjacent one inclined surface of the ramp formation when the hub and rim portions are in normal operating, coplanar interlocked position and being distorted by the ramp formation upon movement of the associated hub portion to combination change position displaced from the plan of the associated rim portion to engage an opposite inclined portion of the ramp formation and resiliently restrain the associated hub and rim portions in the combination change position.

12. A combination lock as defined in claim 4, wherein the outer rim portions of each of said tumbler wheels has a center opening having a diameter corresponding substantially to the outer diameter of the center hub portion and said center opening of the rim portion and the outer perimeter of said hub portion having confronting substantially cylindrical surfaces adapted to releasably abut each other with the rim and hub portions in coplanar alignment and interrupted by tooth formations on each of the hub and rim portions to interfit with each other restraining the associated hub and rim against relative rotation when in the coplanar normal operating position, the surface of the perimeter of each hub portion having a generally triangular ramp formation encircling the hub portion and the confronting portions of the center opening surface of the associated rim portion having a circular recess therein receiving a spring member encircling the confronting hub portion and destorted from circular configuration to project portions thereof from said recess into engagement with the confronting perimeter surface of the associated hub portion, the spring member engaging and being disposed adjacent one inclined surface of the ramp formation when the hub and rim portions are in normal operating, coplanar interlocked position and being distorted by the ramp formation upon movement of the associated hub portion to combination change position displaced from the plane of the associated rim portion to engage an opposite inclined portion of the ramp formation and resiliently restrain the associated hub and rim portions in the combination change position.

13. A combination lock as defined in claim 7, wherein the outer rim portions of each of said tumbler wheels has a center opening having a diameter corresponding substantially to the outer diameter of the center hub portion and said center opening of the rim portion and the outer perimeter of said hub portion having confronting substantially cylindrical surfaces adapted to releasably abut each other with the rim and hub portions in coplanar alignment and interrupted by tooth formations on each of the hub and rim portions to interfit with each other restraining the associated hub and rim against relative rotation when in the coplanar normal operating position, the surface of the perimeter of each hub portion having a generally triangular ramp formation encircling the hub portion and the confronting portions of the center opening surface of the associated rim portion having a circular recess therein receiving a spring member encircling the confronting hub portion and destorted from circular configuration to project portions thereof from said recess into engagement with the confronting perimeter surface of the associated hub portion, the spring member engaging and being disposed adjacent one inclined surface of the ramp formation when the hub and rim portions are in normal operating, coplanar interlocked position and being distorted by the ramp formation upon movement of the associated hub portion to combination change position displaced from the plan of the associated rim portion to engage an opposite inclined portion of the ramp formation and resiliently restrain the associated hub and rim portions in the combination change position.

14. A combination lock as defined in claim 8, wherein the outer rim portions of each of said tumbler wheels has a center opening having a diameter corresponding substantially to the outer diameter of the center hub portion and said center opening of the rim portion and the outer parameter of said hub portion having confronting substantially cylindrical surfaces adapted to releasably abut each other with the rim and hub portions in coplanar alignment and interrupted by tooth formations on each of the hub and rim portions to interfit with each other restraining the associated hub and rim against relative rotation when in the coplanar normal operating position, the surface of the perimeter of each hub portion having a generally triangular ramp formation encircling the hub portion and the confronting portions of the center opening surface of the associated rim portion having a circular recess therein receiving a spring member encircling the confronting hub portion and destorted from circular configuration to project portions thereof from said recess into engagement with the confronting perimeter surface of the associated hub portion, the spring member engaging and being disposed adjacent one inclined surface of the ramp formation when the hub and rim portions are in normal operating, coplanar interlocked position and being distorted by the ramp formation upon movement of the associated hub portion to combination change position displaced from the plan of the associated rim portion to engage an opposite inclined portion of the ramp formation and resiliently restrain the associated hub and rim portions in the combination change position.

15. A combination lock as defined in claim 7, wherein said secondary change fence in a hollow tubular member having teeth to interfit true gates of the tumbler wheels and providing an interior cavity entirely surrounded laterally by outer walls of the tubular member, said actuator being in the form of an elongated bar of rectangular cross-section extending from and rotatable with said gear formation through said cavity to rotate therein and engage inner surfaces of said outer walls bounding said cavity to cam the change fence along a rectilinear path into and out of interfitted rotation with the tumbler wheel gates.

16. A combination lock as defined in claim 8, wherein said secondary change fence in a hollow tubular member having teeth to interfit true gates of the tumbler wheels and providing an interior cavity entirely surrounded laterally by outer walls of the tubular member, said actuator being n the form of an elongated bar of rectangular cross-section extending from and rotatable with said gear formation through said cavity to rotate therein and engage inner surfaces of said outer walls bounding said cavity to cam the change fence along a rectilinear path into and out of interfitted rotation with the tumbler wheel gates.

17. A combination lock as defined in claim 13, wherein said secondary change fence in a hollow tubular member having teeth to interfit true gates of the tumbler wheels and providing an interior cavity entirely surrounded laterally by outer walls of the tubular member, said actuator being in the form of an elongated bar of rectangular cross-section extending from and rotatable with said gear formation through said cavity to rotate therein and engage inner surfaces of said outer walls bounding said cavity to cam the change fence along a rectilinear path into and out of interfitted rotation with the tumbler wheel gates.

18. A combination lock as defined in claim 14, wherein said secondary change fence in a hollow tubular member having teeth to interfit true gates of the tumbler wheels and providing an interior cavity entirely surrounded laterally by outer walls of the tubular member, said actuator being in the form of an elongated bar of rectangular cross-section extending from and rotatable with said gear formation through said cavity to rotate therein and engage inner surfaces of said outer walls bounding said cavity to cam the change fence along a rectilinear path into and out of interfitted rotation with the tumbler wheel gates.

19. A combination lock as defined in claim 15 wherein said lock includes a stationary plate member defining a pair of rectilinear guide surfaces paralleling the path of sliding movement of the change fence and the outer walls of said change fence having projecting tabs bearing against and guided by said guide surfaces to guide the change fence along said path.

20. A combination lock as defined in claim 16 wherein said lock includes a stationary plate member defining a pair of rectilinear guide surfaces paralleling the path of sliding movement of the change fence and the outer walls of said change fence having projecting tabs bearing against and guided by said guide surfaces to guide the change fence along said path.

21. A combination lock as defined in claim 17 wherein said lock includes a stationary plate member defining a pair of rectilinear guide surfaces paralleling the path of sliding movement of the change fence and the outer walls of said change fence having projecting tabs bearing against and guided by said guide surfaces to guide the change fence along said path.

22. A combination lock as defined in claim 18 wherein said lock includes a stationary plate member defining a pair of rectilinear guide surfaces paralleling the path of sliding movement of the change fence and the outer walls of said change fence having projecting tabs bearing against and guided by said guide surfaces to guide the change fence along said path.

23. A combination lock as defined in claim 1, including a fence lever hold-down spring member having an elongated leaf-spring arm portion fixed at one end to a stationary support in the lock case and having an inclined tip formation at its other end resiliently bearing against a side portion of the fence lever when the lock is in locked condition and engageable with an upper edge of the fence lever when it is lowered to unlocking position to resiliently restrain the fence lever in lowered position during unlocking and relocking movement thereof.

24. A combination lock as defined in claim 3, including a fence lever hold-down spring member having an elongated leaf-spring arm portion fixed at one end to a stationary support in the lock case and having an inclined tip formation at its other end resiliently bearing against a side portion of the fence lever when the lock is in locked condition and engageable with an upper edge of the fence lever when it is lowered to unlocking position to resiliently restrain the fence lever in lowered position during unlocking and relocking movement thereof.

25. A combination lock as defined in claim 9, including a fence lever hold-down spring member having an elongated leaf-spring arm portion fixed at one end to a stationary support in the lock case and having an inclined tip formation at its other end resiliently bearing against a side portion of the fence lever when the lock is in locked condition and engageable with an upper edge of the fence lever when it is lowered to unlocking position to resiliently restrain the fence lever in lowered position during unlocking and relocking movement thereof.

26. A combination lock as defined in claim 15, including a fence lever hold-down spring member having an elongated leaf-spring arm portion fixed at one end to a stationary support in the lock case and having an inclined tip formation at its other end resiliently bearing against a side portion of the fence lever when the lock is in locked condition and engageable with an upper edge of the fence lever when it is lowered to unlocking position to resiliently restrain the fence lever in lowered position during unlocking and relocking movement thereof.

* * * * *